US006544344B2

(12) United States Patent
Hegeman et al.

(10) Patent No.: US 6,544,344 B2
(45) Date of Patent: Apr. 8, 2003

(54) DISHWASHER INCLUDING A TURBIDITY SENSOR

(75) Inventors: Arian Johannes Hegeman, Pembroke, NH (US); Omar Haidar, Louisville, KY (US); Michael Lee McIntyre, Cox's Creek, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/916,812

(22) Filed: Jul. 27, 2001

(65) Prior Publication Data

US 2003/0019510 A1 Jan. 30, 2003

(51) Int. Cl.[7] ..... B08B 7/04

(52) U.S. Cl. ..... 134/18; 134/25.2; 134/56 D; 134/57 D; 134/58 D

(58) Field of Search ..... 134/18, 25.1, 25.2, 134/56 D, 57 D, 58 D, 113; 68/12.02

(56) References Cited

U.S. PATENT DOCUMENTS 4,241,400 A 12/1980 Kiefer
4,673,441 A * 6/1987 Mayers ..... 134/104.4
5,560,060 A 10/1996 Dausch et al.
5,586,567 A 12/1996 Smith et al.
5,731,868 A 3/1998 Okey et al.
5,800,628 A 9/1998 Erickson et al.
5,803,985 A 9/1998 Alvord
5,828,458 A * 10/1998 Taylor et al. ..... 356/440
5,889,192 A 3/1999 Engel
5,905,648 A 5/1999 Badami
5,957,144 A 9/1999 Neff et al.
6,007,640 A 12/1999 Neff et al.

* cited by examiner

*Primary Examiner*—Alexander Markoff
(74) *Attorney, Agent, or Firm*—Armstrong Teasdale LLP

(57) ABSTRACT

In one aspect, a dishwasher comprising a control mechanism coupled to a sensor for generating an output representative of an amount of soil in the dishwasher water is described. The dishwasher comprises a tub, at least one filter for filtering water in the tub, and a fluid circulation assembly for circulating water in the tub. The control mechanism is configured to determine whether corrective action is needed to unclog the filter based on a signal output by the sensor.

17 Claims, 4 Drawing Sheets

DISHWASHER INCLUDING A TURBIDITY SENSOR

BACKGROUND OF THE INVENTION

This invention relates generally to dishwashers, and, more particularly, to utilizing a turbidity sensor to facilitate ensuring consistent and thorough cleaning in a dishwasher.

Known dishwasher systems include a main pump assembly and a drain pump assembly for circulating and draining wash fluid within a wash chamber located in a cabinet housing. The main pump assembly feeds washing fluid to various spray arm assemblies for generating washing sprays or jets on dishwasher items loaded into one or more dishwasher racks disposed in the wash chamber. Fluid sprayed onto the dishwasher items is collected in a sump located in a lower portion of the wash chamber, and water entering the sump is filtered through one or more coarse filters to remove soil and sediment from the washing fluid.

If a filter is clogged, the cleaning performance of the dishwasher can decrease as compared to the cleaning performance of the dishwasher if the filter is not clogged. Specifically, food particles from the clogged filter as well as food particles that would otherwise be captured by the filter are recirculated and redeposited onto the dishes.

BRIEF SUMMARY OF THE INVENTION

In one aspect, a dishwasher comprising a control mechanism coupled to a sensor for generating an output representative of an amount of soil in the dishwasher water is provided. The dishwasher comprises a tub, at least one filter for filtering water in the tub, and a fluid circulation assembly for circulating water in the tub. The control mechanism is configured to determine whether corrective action is needed to unclog the filter based on a signal output by the sensor.

In another aspect, a method for controlling operation of a dishwasher is provided. The dishwasher comprises a tub, at least one filter for filtering water in the tub, a sensor in flow communication with the tub, and a fluid circulation assembly for circulating water in the tub. The method comprising the steps of determining whether the filter is clogged based on an output signal from the sensor, and if the filter is clogged, taking corrective action.

In yet another aspect, a kit comprising a turbidity sensor for coupling to a tub of a dishwasher is provided. The sensor is configured to couple to a control mechanism comprising a processor programmed to determine whether corrective action is needed to unclog a filter in the tub based on an output of said sensor.

DETAILED DESCRIPTION OF THE INVENTION

Figure 1:
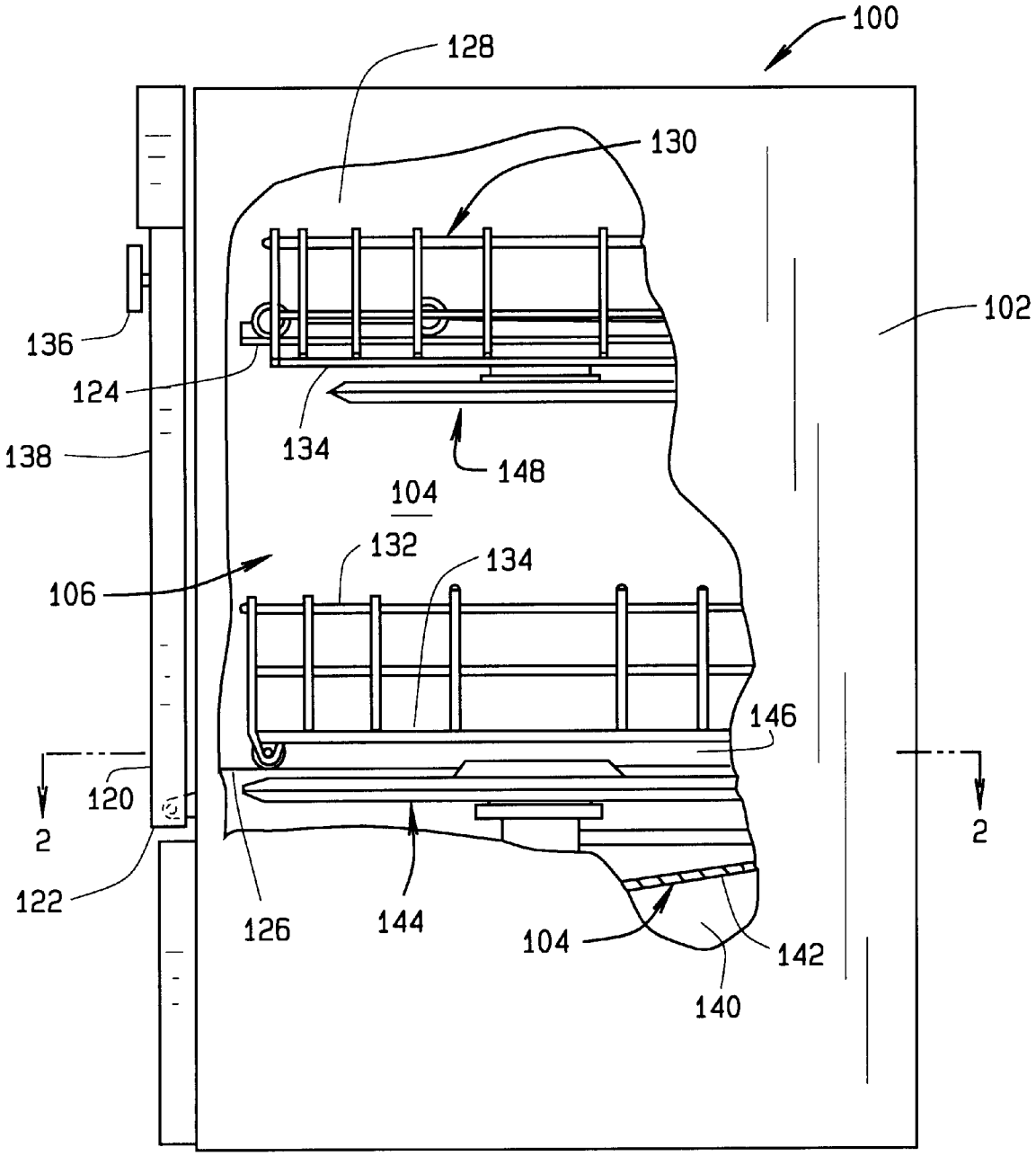
FIG. 1 a side elevational view of an example dishwasher system partially broken away.

FIG. 1 is a side elevational view of an exemplary domestic dishwasher system 100 partially broken away, and in which the present invention may be practiced. It is contemplated, however, that the invention may be practiced in other types of dishwashers and dishwasher systems other than just dishwasher system 100 described and illustrated herein. Accordingly, the following description is for illustrative purposes only, and the invention is not limited to use in a particular type of dishwasher system, such as dishwasher system 100.

Dishwasher 100 includes a cabinet 102 having a tub 104 therein and forming a wash chamber 106. Tub 104 includes a front opening (not shown in FIG. 1) and a door 120 hinged at its bottom 122 for movement between a normally closed vertical position (shown in FIG. 1) wherein wash chamber is sealed shut for washing operation, and a horizontal open position (not shown) for loading and unloading of dishwasher contents.

Upper and lower guide rails 124, 126 are mounted on tub side walls 128 and accommodate upper and lower roller-equipped racks 130, 132, respectively. Each of upper and lower racks 130, 132 is fabricated from/known materials into lattice structures including a plurality of elongate members 134, and each rack 130, 132 is adapted for movement between an extended loading position (not shown) in which at least a portion of the rack is positioned outside wash chamber 106, and a retracted position (shown in FIG. 1) in which the rack is located inside wash chamber 106. Conventionally, a silverware basket (not shown) is removably attached to lower rack 132 for placement of silverware, utensils, and the like that are too small to be accommodated by upper and lower racks 130, 132.

A control input selector 136 is mounted at a convenient location on an outer face 138 of door 120 and is coupled to known control circuitry (not shown) and control mechanisms (not shown) for operating a fluid circulation assembly (not shown in FIG. 1) for circulating water and dishwasher fluid in dishwasher tub 104. The fluid circulation assembly is located in a machinery compartment 140 located below a bottom sump portion 142 of tub 104, and its construction and operation is explained in detail below.

A lower spray-arm-assembly 144 is rotatably mounted within a lower region 146 of wash chamber 106 and above tub sump portion 142 so as to rotate in relatively close proximity to lower rack 132. A mid-level spray-arm assembly 148 is located in an upper region of wash chamber 106 in close proximity to upper rack 130 and at a sufficient height above lower rack 132 to accommodate items such as a dish or platter (not shown) that is expected to be placed in lower rack 132. In a further embodiment, an upper spray arm assembly (not shown) is located above upper rack 130 at a sufficient height to accommodate a tallest item expected to be placed in upper rack 130, such as a glass (not shown) of a selected height.

Lower and mid-level spray-arm assemblies 144, 148 and the upper spray arm assembly are fed by the fluid circulation assembly, and each spray-arm assembly includes an arrangement of discharge ports or orifices for directing washing liquid onto dishes located in upper and lower racks 130, 132, respectively. The arrangement of the discharge ports in at least lower spray-arm assembly 144 results in a rotational force as washing fluid flows through the discharge ports. The resultant rotation of lower spray-arm assembly 144 provides coverage of dishes and other dishwasher contents with a washing spray. In various alternative embodiments, mid-level spray arm 148 and/or the upper spray arm are also rotatably mounted and configured to generate a swirling spray pattern above and below upper rack 130 when the fluid circulation assembly is activated.

Figure 2:
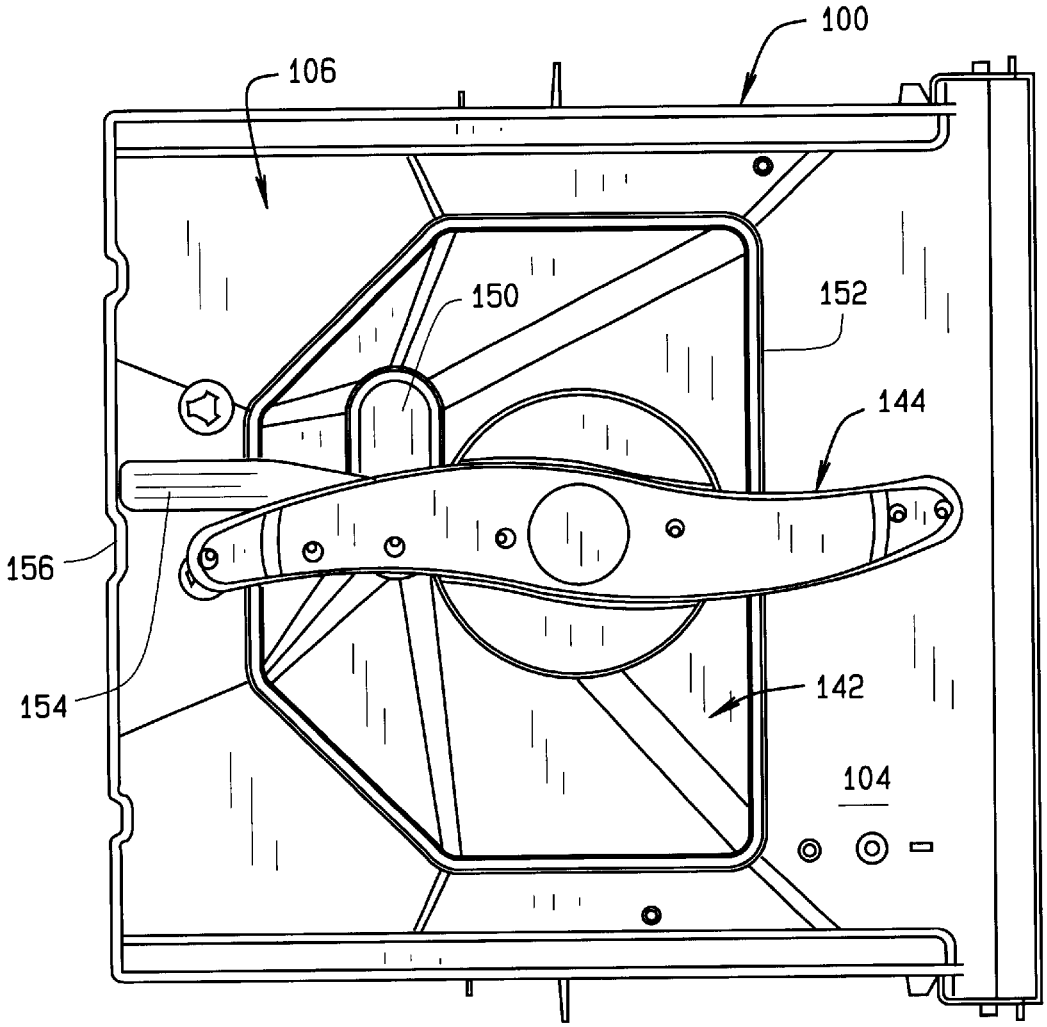
FIG. 2 is a top plan view of a portion of the dishwasher system shown in FIG. 1 along line 2—2.

FIG. 2 is a top plan view of a dishwasher system 100 just above lower spray arm assembly 144. Tub 104 is generally downwardly sloped beneath lower spray arm assembly 144 toward tub sump portion 142, and tub sump portion is generally downwardly sloped toward a sump 150 in flow communication with the fluid circulation assembly (not shown in FIG. 2). Tub sump portion 142 includes a six-sided outer perimeter 152. Lower spray arm assembly is substantially centered within tub 104 and wash chamber 106, off-centered with respect to tub sump portion 142, and positioned above tub 104 and tub sump portion 142 to facilitate free rotation of spray arm 144.

Tub 104 and tub sump portion 142 are downwardly sloped toward sump 150 so that water sprayed from lower spray arm assembly 144, mid-level spray arm assembly 148 (shown in FIG. 1) and the upper spray arm assembly (not shown) is collected in tub sump portion 142 and directed toward sump 150 for filtering and re-circulation, as explained below, during a dishwasher system wash cycle. In addition, a conduit 154 extends beneath lower spray arm assembly 144 and is in flow communication with the fluid circulation assembly. Conduit 154 extends to a back wall 156 of wash chamber 106, and upward along back wall 156 for feeding wash fluid to mid-level spray arm assembly 148 and the upper spray arm assembly.

Figure 3:
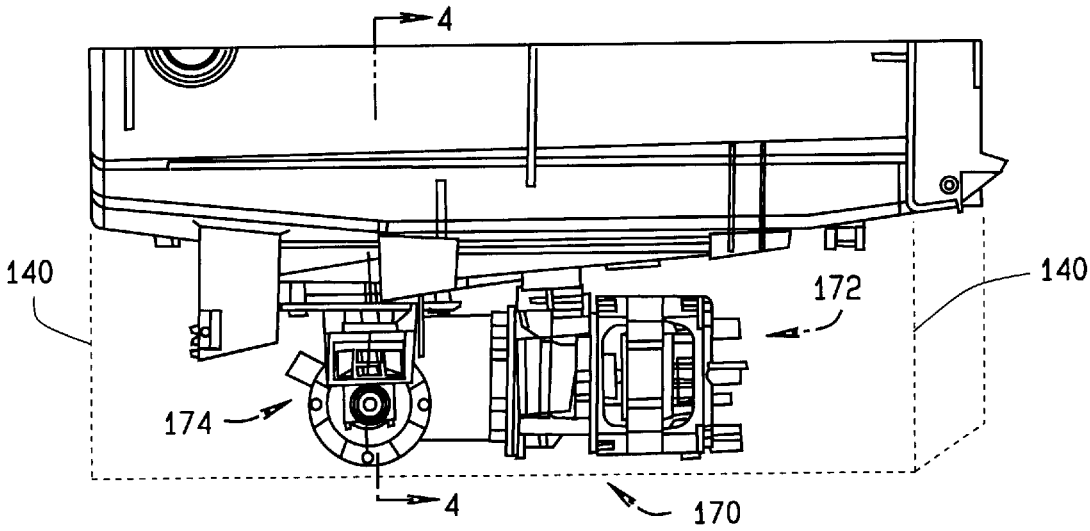
FIG. 3 is a partial side elevational view of the portion of the dishwasher system shown in FIG. 2.

FIG. 3 illustrates fluid circulation assembly 170 located below wash chamber 106 (shown in FIGS. 1 and 2) in machinery compartment 140 (shown in phantom in FIG. 3). Fluid circulation assembly 170 includes a main pump assembly 172 established in flow communication a building plumbing system water supply pipe (not shown) and a drain pump assembly 174 in fluid communication with sump 150 (shown in FIG. 2) and a building plumbing system drain pipe (not shown).

Figure 4:
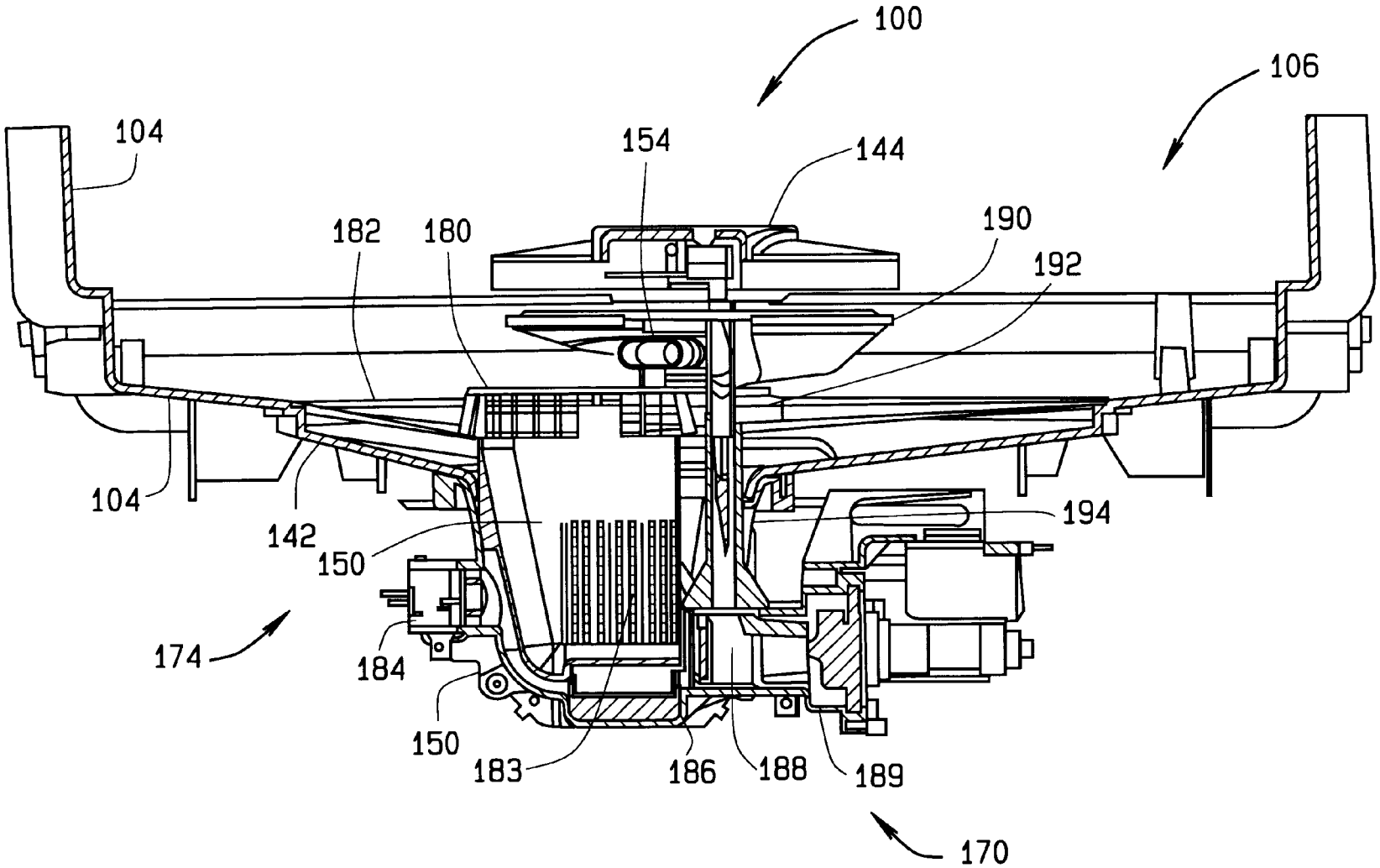
FIG. 4 is a cross sectional schematic view of the portion of the dishwasher system shown in FIG. 3 along line 4—4.

FIG. 4 is a cross sectional schematic view of dishwasher system 100, and more specifically of fluid circulating assembly 170 through drain pump assembly 174. Tub 104 is downwardly sloped toward tub sump portion 142, and tub sump portion is downwardly sloped toward sump 150. As wash fluid is pumped through lower spray arm assembly 144, and further delivered to mid-level spray arm assembly 148 (shown in FIG. 1) and the upper spray arm assembly (not shown), washing sprays are generated in wash chamber 106, and wash fluid collects in sump 150.

Sump 150 includes a cover 180 to prevent larger objects from entering sump 150, such as a piece of silverware or another dishwasher item that is dropped beneath lower rack 132 (shown in FIG. 1). A course filter 182 is located to filter wash fluid for sediment and particles of a predetermined size before flowing into sump 150 over tub sump portion 142. Wash fluid flowing through cover 180 flows through coarse inlet filter 183 into sump 150.

A drain check valve 186 is established in flow communication with sump 150 and opens or closes flow communication between sump 150 and a drain pump inlet 188. A drain pump 189 is in flow communication with drain pump inlet 188 and includes an electric motor for pumping fluid at inlet 188 to a pump discharge (not shown in FIG. 4) and ultimately to a building plumbing system drain (not shown). When drain pump is energized, a negative pressure is created in drain pump inlet 188 and drain check valve 186 is opened, allowing fluid in sump 150 to flow into fluid pump inlet 188 and be discharged from fluid circulation assembly 170.

A fine filter assembly 190 is located below lower spray arm assembly and above tub sump portion 142. As wash fluid is pumped into lower spray arm 144 to generate a washing spray in wash chamber 106, wash fluid is also pumped into fine filter assembly 190 to filter wash fluid sediment and particles of a smaller size than coarse filters 182 and 183. Sediment and particles incapable of passing through fine filter assembly 190 are collected in fine filter assembly 190 and placed in flow communication with a fine filter drain tube 192 received in a fine filter drain docking member 194, which is, in turn, in flow communication with drain pump inlet 188. Thus, when pressure in fine filter assembly 190 exceeds a predetermined threshold, thereby indicating that fine filter assembly is clogged with sediment, drain pump 189 can be activated to drain fine filter assembly. Down jets (not shown) of lower spray arm assembly 144 spray fluid onto fine filter assembly 190 to clean fine filter assembly during purging or draining of fine filter assembly 190.

Figure 5:
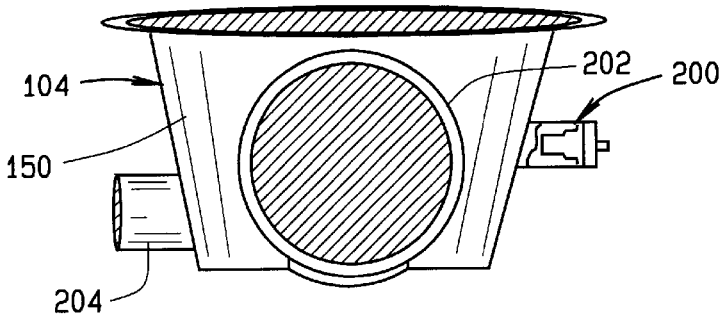
FIG. 5 is a schematic illustration of a sump and a turbidity sensor coupled thereto.

FIG. 5 is a schematic illustration of sump portion 150 of tub 104 and a turbidity sensor 200 coupled thereto. A first outlet 202 of sump portion 150 is in flow communication with drain pump inlet 188 (FIG. 4) and a second outlet 204 of sump portion 150 is in flow communication with an auxiliary pump (not shown).

Turbidity sensor 200 is coupled to the dishwasher control mechanism, and sensor 200 generates an output signal representative of a level of sediment in tub 104. Turbidity sensors are commercially available. An example turbidity sensor is Model TS15, commercially available from Elektromanufaktur Zangenstein Hanauer GmbH & Co., KgaA Siemensstrabe 1, Nabburg D-92507.

Generally, turbidity sensor 200 generates a signal representative of the soil level in water by sensing light transmittance from a light emitting diode (LED) at a known wavelength. Any particles in the water inhibit light transmittance. Therefore, as the soil level in the water rises, the voltage level of the signal output by sensor 200 decreases. Air bubbles also inhibit light transmittance. When sensor 200 is fully submerged in static or smooth dynamic (i.e., without bubbles) water, the output signal from sensor 200 is stable.

Figure 6:
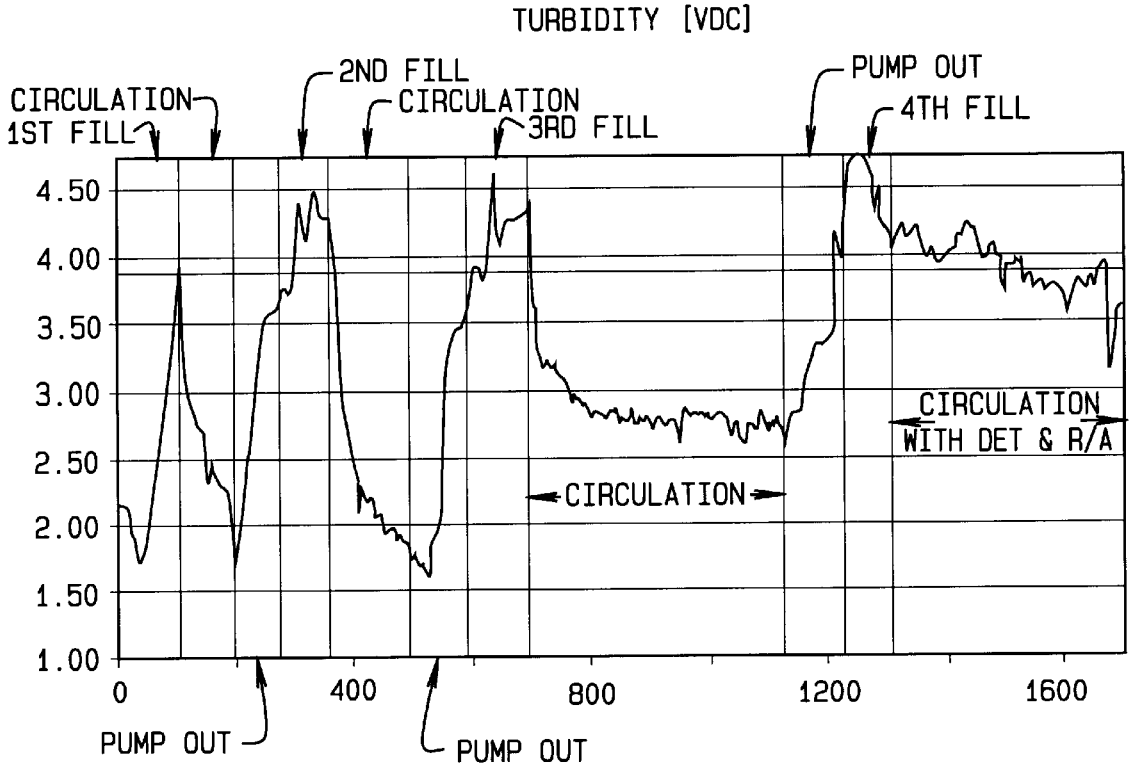
FIG. 6 is a graphical representation of an example signal output by the turbidity sensor shown in FIG. 5 during a wash cycle.

FIG. 6 is a graphical representation of an example signal output by sensor 200 during a wash cycle. The x-axis is time, and the y-axis is the magnitude of the voltage level of the signal output by sensor 200. The example wash cycle includes four fill operations, four circulation operations, and four pump outs.

As shown in FIG. 6 in the example wash cycle, during a first fill ($1^{st}$ Fill) operation, the sensor output signal increases due to the sensor getting submerged by water. During circulation, however, the sensor output signal decreases due to the increase of particles that have been rinsed off the dishes into the water. The water is then pumped out of the dishwasher and a second fill ($2^{nd}$ Fill) operation is performed. The presence of air in the tub, and then clean water results in the sensor output signal increasing until the next circulation operation. As with the first circulation operation, the sensor output signal again decreases due to the increase of particles in the water. The water is then pumped out and a third fill ($3^{rd}$ Fill) operation is performed. Comparing the sensor output signal subsequent to the third fill operation to the sensor output signal subsequent to the first and second fill operations, less soil is present in the water subsequent to the third fill operation.

During circulation, if the output signal from sensor 200 decreases rapidly, heavy soil is present on the dishes and corrective measures are executed to prevent filter clogging. For example, in one embodiment, the control mechanism includes a microprocessor programmed to compare the magnitude of the voltage signal output from sensor 200 to a previously output voltage signal magnitude from sensor 200. This comparison can be performed at a selectable rate, e.g., once every 1–60 seconds the immediately preceding voltage magnitude is compared to the current magnitude. If the voltage magnitude remains within a band for a selected number of comparisons, e.g., if the voltage signal magnitude is plus or minus 0.50 volts for 5 comparisons, then a decrease rate is determined for the sensor signal and corrective action is performed.

The corrective action can take many different forms. Generally, the objectives of the corrective action include unclogging the filter and/or washing off the sensor so that inaccurate readings are avoided. For example, upon identification of a low output signal as described above, a drain sequence can be initiated and water can be pumped onto the filter to wash off the filter.

The above described process facilitates enhancing the effectiveness of dishwasher filters since clogged filters are predicted and corrective action can be taken. Such sensing and corrective action facilitate consistent and thorough cleaning of dishes. As explained above, utilizing a turbidity sensor as described herein is not limited to practice with a specific dishwasher such as the three level dishwasher described above. A turbidity sensor as described above can be utilized in many different types and models of dishwashers.

While the invention has been described in terms of various specific embodiments, those skilled in the art will recognize that the invention can be practiced with modification within the spirit and scope of the claims.

What is claimed is:

1. A dishwasher comprising:

a tub;

at least one filter for filtering water in said tub;

a turbidity sensor in flow communication with said tub;

a fluid circulation assembly for circulating water in said tub; and a control mechanism coupled to said turbidity sensor and to said fluid circulation assembly, said control mechanism configured to determine a clogged state of said filter by monitoring an output signal from said turbidity sensor and comparing said output signal to previously output signals from said turbidity sensor, said control system further configured to determine whether corrective action should be taken to unclog said filter based on said comparison of output signals from said turbidity sensor.

2. A dishwasher according to claim 1 wherein to determine whether corrective action is needed to unclog the filter, said control mechanism:

determines whether an output voltage signal from said turbidity sensor has remained within a predetermined voltage band relative to previous voltage signals for a predetermined period of time during a wash cycle, and if said output voltage signal has remained within said predetermined voltage band for said predetermined period of time, then determines that corrective action is needed.

3. A dishwasher according to claim 1 wherein said corrective action comprises at least one of unclogging said filter and washing soil off said filter.

4. A dishwasher according to claim 1 wherein said corrective action comprises pumping water out of said tub.

5. A dishwasher according to claim 1 wherein said tub comprises a sump portion, and wherein said sensor is coupled to said tub at said sump portion.

6. A method for controlling operation of a dishwasher, the dishwasher including a tub, at least one filter for filtering water in the tub, a turbidity sensor in flow communication with the tub, and a fluid circulation assembly for circulating water in the tub, said method comprising the steps of:

monitoring a voltage signal output of the turbidity sensor;

determining whether the filter is or may become clogged based on a threshold decrease in the voltage output signal from the turbidity sensor, and if the filter is or may become clogged, taking corrective action to unclog the filter.

7. A method according to claim 6 wherein determining whether the filter is clogged comprises the step of determining whether an output voltage signal from the sensor has remained within a predetermined voltage band for a predetermined period of time.

8. A method according to claim 6 wherein taking corrective action comprises at least one of the steps of unclogging the filter and washing soil off the filter.

9. A method according to claim 6 wherein taking corrective action comprises pumping water out of the tub.

10. A dishwasher control kit comprising:

a turbidity sensor for coupling to a tub of a dishwasher; and a control mechanism comprising a processor programmed to determine whether corrective action is needed to unclog a filter in the tub based on a predetermined output signal decrease of said turbidity sensor during a wash cycle.

11. A kit according to claim 10 wherein to determine whether corrective action is needed, the control mechanism:

determines whether an output voltage signal from said sensor has remained within a predetermined voltage band for a predetermined period of time, and if said output voltage signal has remained within said predetermined voltage band for said predetermined period of time, then determines that corrective action is needed.

12. A kit according to claim 10 wherein the corrective action comprises at least one of unclogging the filter and washing soil off the filter.

13. A kit according to claim 10 wherein the corrective action comprises pumping water out of the tub.

14. A kit according to claim 10 wherein the tub comprises a sump portion, and wherein said sensor is configured to couple to the tub at the sump portion.

15. A dishwasher comprising:

a tub;

at least one filter for filtering water in said tub;

a turbidity sensor in flow communication with said tub;

a fluid circulation assembly for circulating water in said tub; and a control mechanism coupled to said turbidity sensor and to said fluid circulation assembly, said control mechanism configured to:

operate said fluid circulation assembly in at least one designated portion of a wash cycle;

during operation of said fluid circulation assembly, sample an output signal from said turbidity sensor at a predetermined rate;

compare sampled output signals to previously received output signals during operation of said fluid circulation assembly; and when sampled output signals have changed by at least a threshold amount during operation of the fluid circulation assembly, taking corrective action to unclog said filter.

16. A dishwasher in accordance with claim 15 wherein said control mechanism is configured to compare a voltage of sampled output voltage to previously received voltage output signals from said turbidity sensor.

17. A dishwasher in accordance with claim 15 wherein said control mechanism is configured to take corrective action when sampled output signals from the turbidity sensor have decreased below a predetermined output threshold.

* * * * *

UNITED STATES PATENT AND TRADEMARK OFFICE

CERTIFICATE OF CORRECTION

PATENT NO. : 6,544,344 B2
DATED : April 8, 2003
INVENTOR(S) : Hegeman et al.

It is certified that error appears in the above-identified patent and that said Letters Patent is hereby corrected as shown below:

Title page,
Item [75], Inventors, delete "Arian" and insert therefor --Arjan --.

Signed and Sealed this

Sixteenth Day of September, 2003

JAMES E. ROGAN
*Director of the United States Patent and Trademark Office*